United States Patent [19]

Marshall

[11] Patent Number: 4,653,591

[45] Date of Patent: Mar. 31, 1987

[54] METHOD OF PRODUCING FOAM AND FOAM GENERATOR

[76] Inventor: James S. Marshall, 181 Amaral St., East Providence, R.I. 02915

[21] Appl. No.: 788,795

[22] Filed: Oct. 18, 1985

Related U.S. Application Data

[63] Continuation-in-part of Ser. No. 432,291, Sep. 6, 1983, abandoned.

[51] Int. Cl.[4] ..... A62L 35/00

[52] U.S. Cl. ..... 169/15; 169/44

[58] Field of Search ..... 239/690, 692, 415, 693, 239/699, 418, 415, 343, 326.3, 428.5, 696, 704; 137/78.1, 78.5; 169/14, 15, 30

[56] References Cited

U.S. PATENT DOCUMENTS 3,620,306 11/1971 Shepherd ..... 169/15
3,811,660 5/1974 Cole ..... 169/15 X

FOREIGN PATENT DOCUMENTS 321634 10/1934 Italy ..... 169/15
1284757 8/1972 United Kingdom .
271483 3/1969 U.S.S.R. ..... 239/696

*Primary Examiner*—Andres Kashnikow
*Assistant Examiner*—Kevin Patrick Weldon
*Attorney, Agent, or Firm*—Robert J. Doherty

[57] ABSTRACT

A foam generation device and method of producing foam wherein an electrical charge is placed upon a foam producing solution or admixture thereof with air. The above admixture is then forced by air pressure through a grounded foam-producing mesh such that foam bubbles are produced at high efficiency. In addition, the turbulence of the air passing through the device may be reduced by a honeycomb section. This honeycomb section in turn may be grounded and the air flow through the device reversed such that already produced foam may be drawn into the device, charged by the grid, and thereafter dissipated upon the honeycomb section.

8 Claims, 3 Drawing Figures

METHOD OF PRODUCING FOAM AND FOAM GENERATOR

This application is a Continuation-In-Part of my copending application Ser. No. 432,291 filed Sept. 6, 1983 now abandoned.

BACKGROUND AND OBJECTS OF THE INVENTION

This invention relates to foam generation and the means for producing such foam. Foam generators, especially high expansion foam generators, have been developed to exploit the particular advantages of high expansion foam. One is the capacity of high expansion foam to completely fill a confined area with the item generated known as a foam plug. The second is that owing to its low density, it will generally float on all types of flammable liquids; and if the capacity of the foam is sufficient to cover the entire surface of a flammable liquid pool, then thru the exclusion of air or oxygen from the liquid pool by the covering action of the foam, often described as the foam blanket, the fire is extinguished. The third advantage has been that different gases, though these gases must be usually pure gases, may be used to generate or be entrained in the foam. With this capability, foams with fractions of extinguishing class gas may be applied to fires with more positive results than with either the gas or foams themselves. The inventor himself has generated foam of equal consistency using air; and air with large fractions of CO and N .

A fourth advantage is that many foam generators can be designed as portable units (see U.S. Pat. No. 3,343,271). Inasmuch as the power required to generate may be as low as ½ horsepower and one gallon of foam solution will generally yield 1000 gallons of foam, it is well within the realm of an individual to hand carry both generator and foam solution from storage to site; and unlike other extinguishing methods, it is one of the few that can physically fill the whole of a room without chance of immediate dissipation. Another advantage is that through the fact that such a small amount of liquid is used in proportion to its volume, water damage is minimal, and reapplication of foam for deep seated fires is not nearly as critical a decision as it is when water is considered.

For both its composition and capabilities it may be determined that high expansion foam can be a more efficient and satisfactory extinguishing agent than other types. It was for these reasons that high expansion foam was developed—first for underground fires and then for flammable liquid fires. Although foam has been primarily developed for use as an extinguishing agent, other uses have been cited especialy decontamination (U.S. Pat. No. 3,142,340) by entrapment and subsequent draining off of radioactive particles and as a substitute to agricultural spraying using an analogous method (U.S. Pat. No. 4,070,302).

Prior art on foam generators especially high expansion generators has generally been orientated around functional design (U.S. Pat. No. 3,142,340), application (U.S. Pat. No. 3,212,762 for cleaning, U.S. Pat. No. 3,301,485 for making snow, and the previously mentioned U.S. Pat. No. 4,070,302 for agricultural use), as well as for the more prevalent fire extinguishing applications such as U.S. Pat. No. 3,241,617 and the related U.S. Pat. No. 3,272,263 which are for mine fires, method of application (U.S. Pat. No. 3,402,771 a design for entraining CO ) and specific efficiency (U.S. Pat. No. 4,070,302 a design for especial generation of "dry" foam). Less attention has been made towards recognizing ambient conditions, varying combustible loads in the area to be protected, and presence of smoke evolving from the fire which can be entrained in the foam and has been proven to cause a drastic loss in efficiency in generation, and the cleaning up or removal of the foam after generation.

Only two previous patents have addressed these problems: the aforementioned U.S. Pat. No. 3,402,771 which details the use of multiple nozzles for changing the expansion ratio which is the ratio of air (or gas) entrained by an amount of foam solution, and U.S. Pat. No. 3,407,880 which is a related patent using the products of combustion to extinguish the fire without specifically mentioning foam. Expansion ratio, which is not an efficiency ratio, is directly proportional to air (or gas) supply sometimes referred to as "wind" and indirectly proportional to foam solution supply rate (see "Studies on Generating Mechanism of High Expansion Air Foam: III." Fire Research Institute of Japan Report No. 31, 28 (1970) Tokyo, Japan.) or resistance encountered by the air flow which for a given supply rate will vary as a result. This means that by varying only the surface tension of the foam solution, the expansion ratio will be varied. It is evident that under practical parameters (i.e., how much the foam solution surface tension can be varied) the expansion ratio is equally dependent upon the particular surface tension of foam solution as it is its supply rate and that of the air supply rate. This additional adjustment allows for more precise adjustment of the expansion ratio for more efficiency in generation which in actuality is for this system mounted level according to the energy equation, the difference between the air velocity impinging upon the net, considering the blockage (pressure drop) of the net (see Pope, Harper; "Low Speed Wind Tunnel Testing"; 1966 pp. 116–118, 46 and "Wind Tunnel Technique"; pp. 648–649, 79) It is apparent that more precise adjustment of the surface tension of the foam solution which is also the blockage of the screen to yield a given expansion ratio, will also directly adjust the efficiency of generation.

This invention intends to solve the problem of adjusting expansion ratio while the generator is operating with more precision than has been possible before. Prior methods rely upon the precision of flow valves for adjusting expansion ratio. This invention can rely upon a rheostat control which, when coupled to electronic feedback controls, allows for a greater precision over a range of solution flow. This invention can also allow for the implementation of flow valves for an even wider range of operation. This invention also provides for the removal of generated foam by the simple expedient of reversing the fan motor. This invention also provides for implementation of a plain electrically conductive net such as metal or carbon that is incombustible. Prior art (U.S. Pat. No. 3,142,340) required the use of absorbent cotton or nylon screens that were combustible and required the use of shutters on the discharge of the generator or specially treated or prepared metal nets (U.S. Pat. No. 3,592,269). This invention provides for more efficient foam generation through adjustment of a given foam solution's surface tension, q.v., rather than through manipulation of foam solution or air (or gas) supply rate.

This invention introduces an electric charging grid downstream of the foam solution discharge in order to apply a static charge of varying size to the foam solution droplets which will impinge upon a grounded discharge net hereafter referred to as a collecting plate which will have a mesh or multiple holes integral in its construction. The amount of charge on the droplets known as "attraction" in the field of electrostatics will determine the amount of surface tension existing in the foam solution when it first adheres to the collecting plate.

Aside from the components making up the charging grid and collecting plate for the charged foam solution, two other components are included in this invention which makes it unique from other foam generators. One is the inclusion of a turbulence-reduction screen upstream of the charging grid. Previous tests have indicated that higher expansion ratios of up to 2000:1 can only be realistically achieved with fully developed flow, that is, nonturbulent flow. Since these screens have no deleterious effect on lower expansion ratios of the order of 80% of the maximum ratio realized in the test, they should be included in all designs where varying expansion ratios are required with the highest ratio in the order of 1000:1 or more. The second component is a control box which provides control of the rheostat as it reacts to different ambient conditions of especially air density and quality.

The balance of this invention is conventional in design including a tube-axial multiple-blade fan with a minimum capacity to develop an appropriate pressure head of e.g., 0.7", of water (q.v.) over the whole area of the collector plate. The motor, foam solution reservoir, and in this case the compressed air storage tank are underslung on the fan assembly. A drain is included for removal of run-off from the charging grid in either the generating or "pickup" mode.

Prior art in foam generators have limited their scope to function and application without specifically accommodating for the adjustment of the expansion ratio for varying ambient conditions especially in accommodating for instant feedback control in the design with electric controlling of the expansion ratio. It has been observed in tests (Ref. 2) that given the same air supply rate and the same foam solution rate that different expansion ratios were achieved with different nets on the order of 20%. The changes made in these tests in the nets were to effectively change the absorbent qualities of the nets. Since the surface tension of a fluid determines how much it will be absorbed by a net then applying a static charge to the fluid articles will effectively change the attraction the fluid particles will have for a grounded net composed of electrically conductive materials in an analogous sense change its "absorbent" quality.

This invention implements a net constructed of conductive materials especially materials that are incombustible and have a high melting point and have no special treatment of finish. This obviates the need for a special shutter or indirect or angled discharge chutes that has characterized previous designs.

This invention provides for an extra precision in adjustment of the expansion ratio with a rheostat control while allowing for the adjustment of expansion ratio by varying both the air and foam solution supply rates. It is expected that this extra adjustment is an aid to increase the efficiency of generation of foam in terms of net energy expended.

This invention incorporates turbulence-reducing screens since prior art has indicated that low turbulence in the air supply rate results in higher consistency and efficiency of foam generation. Prior art used long air delivery tunnels to create nearly fully-developed flow while this device implements screens which effectively shorten the length of the delivery tunnel while still providing for low turbulence flow at the expense of power loss. This method allows for portability of the scale device described—a feature that has been designed in prior art but not with the attendant aim of providing for low turbulent flow in the air supply which is essential for the efficient generation of foam.

With the implementation of a reversing motor in the tube-axial fan described in the scale device, it is possible to "pickup" foam. The suction then available in the exit end of the generator will suffice to draw foam into the air and foam delivery tunnel which can then apply a new static charge and result in the foam adhering and decomposing on a collecting grid where the drain off may be conveniently arranged.

Other objects, features and advantages of the invention shall become apparent as the description thereof proceeds when considered in connection with the accompanying illustrative drawing.

DESCRIPTION OF THE PREFERRED EMBODIMENTS

Figure 1:
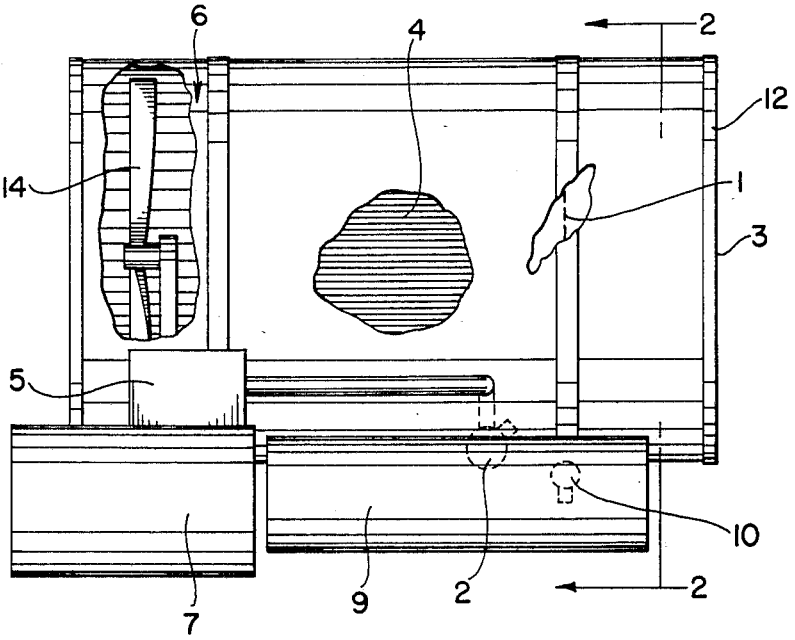
FIG. 1 is a side elevation of a foam generator device illustrating my invention.
Figure 2:
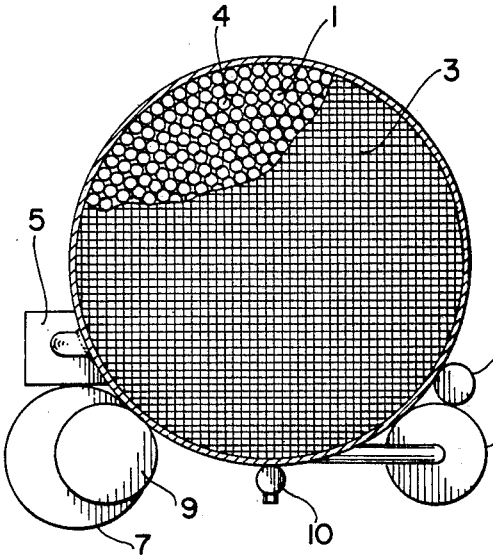
FIG. 2 is an end view elevation taken from the discharge end of the generator.
Figure 3:
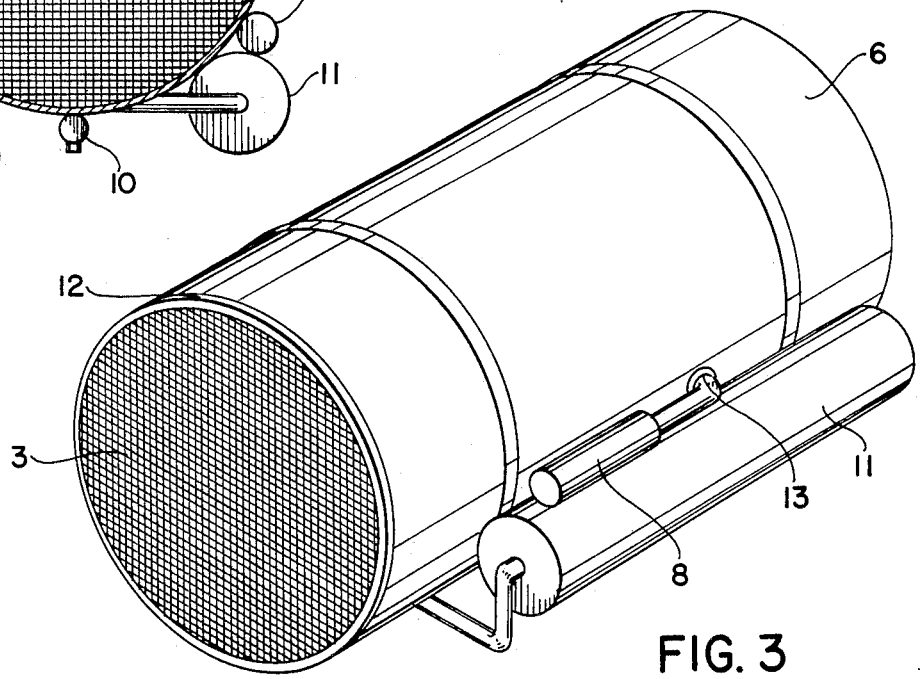
FIG. 3 is a perspective view taken from the side and showing the foam solution and water reservoirs.

Referring to FIG. 1, an actuating switch responding to either manual control, temperature or smoke conditions, turns on the valve to the compressed air tank 9 which drives the motor 7. The motor 7 turns the axial fan 14 mounted in the tube axial fan assembly 6. The actuating switch by relay connection turns on the high voltage DC supply mounted within the control box 5. This supplies a high voltage supply to the charging grid 1. The actuating switch also opens by relay connection the valve leading from the foam solution reservoir 8. The control box 5 has determined the ambient conditions in terms of smoke and air quality and has set the limits on the amount of voltage through a rheostat control to be supplied the charging grid through the nozzle 2.

The fan assembly 6 reaches the operating speed and pushes air through the delivery tube and through the honeycomb section 4 which "straightens" the flow removing turbulence. After passing through this section, it reaches the location of Charging Grid 1 where it mixes with the charged foam solution which has been supplied in a proportion of water from the water tank 11 to foam solution in its reservoir 8. Mixing of the foam solution with the water is accomplished with a proportioning valve 13 while motive power is provided from the same compressed air tank 9 in this device that powers the fan.

The air supply is now composed of air a fraction of foam solution in liquid and vapor phase. This now hits the collecting plate 3 which is grounded by a grounding strap 12. Since the foam solution particles are charged, they are attracted to the collector plate 3 and in some measure depending upon the amount of the charge and the air velocity adheres to this plate 3. The force of the air supply travelling with it is sufficient to create bubbles at each opening in the plate 3 which has multiple holes.

This combination of electrically charging the foam solution and grounding the mesh is believed to account for the increased efficiency of this device. This efficiency is not specifically limited to the making of the actual bubbles of foam at the bubble-forming mesh holes but also includes minimizing fluid loss through drainage by providing for the attraction of the foam solution itself to the mesh, i.e., the adherence of the foam solution to the mesh. This adherence, in effect, can reduce the amount of foam solution which normally would be blown through the mesh as it now can be converted to foam. This adherence is believed to be brought out by both charging the solution and grounding the mesh to which the solution is attracted. The foam that is produced which will have a neutral charge is composed of all the bubbles that have been produced at the collecting plate 3. The foam will continue to be produced until either the foam solution or the air supply is exhausted.

When the motor is operated in reverse of the above description, the fan now creates a suction at the discharge of the generator. It is now possible to draw foam into the generator where it will pass through the multiple-hole collector plate 3 and then be charged by charging grid 1. After passing through the grid, it will meet the honeycomb section 4 which is grounded by the same strap 12 which grounds the collecting plate 3.

Since the surfaces of the foam bubbles will adhere to the surface of the honeycomb sections, this forces the foam to decompose with the foam solution draining off by gravity to the location of the drain 10 where it may be disposed of.

Advantages of this invention are in providing instantaneous and feedback control of the expansion ratio which should be varied for different ambient conditions and different classes of fires. "Dry" foam which is a foam with a small amount of foam solution in proportion to the total amount of foam is best used where volume is required especially in confined spaces. "Wet" foam is best used where the weight of the foam is important as in open spaces and on liquid fires where it is important the foam not be dispersed.

Adjustment of the surface tension in the foam solution provides for an extra measure of precision in generating the foam and hence improved efficiency of generation.

Using a net constructed of conductive materials especially materials that are incombustible and have a high melting point and have no need for special treatment or finish as does this design eliminates a problem that had been solved previously with mechanical shutters and discharge chutes designed to protect cotton and nylon nets which were selected instead of metal nets because of their performance. This invention allows the use of metal screens that offer an equal performance with the means previously described.

Since the inclusion of turbulence reducing screens has been provided for in this design, it is apparent that this device is physically shorter than previous designs at the expense of a small power loss. This fact, coupled with the extra efficiency afforded by this device, and its specific power consumption in proportion to foam generated means that this invention has more capability per unit size than previous units. To define what the inventor means by capability, it does not mean ultimate expansion ratio which is not an efficiency ratio nor does it mean volume of foam generated. It means per unit size and power, it offers more efficient foam production than previous designs of generators.

Since the invention incorporates a charging grid in the body of the generator and the generator can be operated in reverse, it provides for the ordered and uniform decomposition of foam inasmuch as the rate of decomposition is equal to the rate of generation. Previous designs may incorporate reversible motors; but without a charging grid, the foam solution in the foam will not adhere to any particular part of the generation, and decomposition will not be orderly and controlled.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A high expansion foam generator device comprising a chamber having an open end, an electrically conductive and grounded mesh positioned over said open end, an electrically charged grid positioned in said chamber proximal to but spaced from said mesh, means for introducing a solution of foam generating material over said grid and means for moving air through said chamber.

2. The device of claim 1 including control means for varying the electrical charge on said grid.

3. The foam generator of claim 1, said device being a self contained portable unit including a compressed air tank, a solution tank, and d.c. power means, a fan mounted in said chamber proximal the other end for directing a flow of air therethrough.

4. A high expansion foam generator device comprising a chamber having an open end, an electrically conductive and grounded mesh positioned over said open end, an electrically charged grid positioned in said chamber proximal to but spaced from said mesh, means for introducing a solution of foam generating material over said grid and means for moving air through said chamber and including an electrically grounded honeycomb air turbulence reducing section disposed in said chamber upstream of said grid and means for reversing the flow of air through said chamber wherein foam can be drawn into said device for dissipation therein.

5. The method of increasing the efficiency of a high expansion foam generator having a chamber including an electrically conductive mesh positioned at the outlet end thereof, means for disposing a solution of foam generating material on said mesh and means for directing a gas flow from said chamber onto and through said mesh so as to produce a foam via contact with said solution and said mesh, comprising electrically charging said solution an amount adequate to increase the adherence of said solution to said mesh and wherein the electrical charge is introduced to said solution by a positively charged grid positioned in said chamber proximal to but upstream of said mesh and including electrically grounding said mesh.

6. The method of claim 5, including varying the electrical charge on said grid.

7. The method of claim 6, comprising reversing the flow of air while maintaining the charge on said grid so as to dissipate already formed foam.

8. The method of claim 7 including grounding a honeycomb air flow director positioned within said chamber such that said flow director acts as a collector for the dissipated foam.

* * * * *